US007609172B2

(12) United States Patent
Rozum et al.

(10) Patent No.: US 7,609,172 B2
(45) Date of Patent: Oct. 27, 2009

(54) SYSTEM AND METHOD FOR PROVIDING REAL-TIME TRAFFIC INFORMATION

(75) Inventors: Timothy C. Rozum, Olathe, KS (US); Scott J. Brunk, Edgerton, KS (US)

(73) Assignee: Garmin Ltd. (KY)

( * ) Notice: Subject to any disclaimer, the term of this patent is extended or adjusted under 35 U.S.C. 154(b) by 339 days.

(21) Appl. No.: 11/549,106

(22) Filed: Oct. 12, 2006

(65) Prior Publication Data

US 2008/0088480 A1 Apr. 17, 2008

(51) Int. Cl.
*G08G 1/00* (2006.01)

(52) U.S. Cl. ..... 340/901; 701/117; 701/210

(58) Field of Classification Search ..... 340/901, 340/995.13, 995.19; 701/117, 209, 210
See application file for complete search history.

(56) References Cited

U.S. PATENT DOCUMENTS

| | | | | |
|---|---|---|---|---|
| 5,335,180 | A * | 8/1994 | Takahashi et al. | 701/117 |
| 6,161,092 | A | 12/2000 | Latshaw et al. | 704/270 |
| 6,317,686 | B1 * | 11/2001 | Ran | 701/210 |
| 6,574,556 | B2 | 6/2003 | Fish et al. | |
| 6,728,628 | B2 | 4/2004 | Peterson | 701/117 |
| 6,922,629 | B2 * | 7/2005 | Yoshikawa et al. | 701/117 |
| 6,990,407 | B1 * | 1/2006 | Mbekeani et al. | 701/117 |
| 7,027,915 | B2 | 4/2006 | Craine | |
| 7,050,903 | B1 * | 5/2006 | Shutter et al. | 701/117 |
| 7,069,143 | B2 | 6/2006 | Peterson | 701/117 |
| 7,222,018 | B2 * | 5/2007 | Uyeki et al. | 701/209 |
| 7,251,558 | B1 * | 7/2007 | McGrath | 701/117 |
| 2003/0112156 | A1 | 6/2003 | Behr et al. | 340/995.2 |
| 2003/0225508 | A9 * | 12/2003 | Petzold et al. | 701/201 |
| 2004/0143385 | A1 | 7/2004 | Smyth et al. | 701/117 |
| 2005/0033504 | A1 | 2/2005 | Rennels | 701/117 |
| 2005/0288856 | A1 | 12/2005 | Uyeki et al. | 701/210 |
| 2006/0025925 | A1 * | 2/2006 | Fushiki et al. | 701/210 |
| 2006/0058940 | A1 | 3/2006 | Kumagai et al. | 701/117 |
| 2006/0089754 | A1 | 4/2006 | Mortenson | |
| 2006/0089787 | A1 * | 4/2006 | Burr et al. | 701/209 |
| 2006/0247845 | A1 * | 11/2006 | Cera et al. | 701/117 |

OTHER PUBLICATIONS

TMC Compendium Alert-C Coding Handbook, Trafficmaster, Jan. 2, 1999.

$YQ_2$ User Manual and Installation Instructions, Trafficmaster, 1998.

Printout from http://www.tomtom.com/products/product/php?ID=212&Category=0&Lid=1 , 4 pages, printed May 14, 2007.

NUVI 310/360 Owner's Manual; Garmin Ltd., Apr. 2006.

(Continued)

*Primary Examiner*—John A Tweel, Jr.
(74) *Attorney, Agent, or Firm*—Samuel M. Korte

(57) ABSTRACT

A device and method for filtering traffic information. In one embodiment, the device comprises a traffic component, a computing device coupled with the traffic component, and a display coupled with the computing device. The traffic component is operable to receive traffic data corresponding to a plurality of traffic events. The computing device is operable to filter the received traffic data based on the severity of the traffic events to form filtered traffic data and the display is operable to present an indication of the filtered data.

14 Claims, 4 Drawing Sheets

OTHER PUBLICATIONS

StreetPilot 2720 Owner's Manual; Garmin Ltd., Jun. 2005.
International Search Report from International Application No. PCT/US2007/080602, dated Apr. 23, 2009.
International Search Report from corresponding International Application No. PCT/US2007/080586, dated Apr. 23, 2009.

* cited by examiner

SYSTEM AND METHOD FOR PROVIDING REAL-TIME TRAFFIC INFORMATION

BACKGROUND OF THE INVENTION

1. Field of the Invention

Embodiments of the present invention relate to devices, systems, and methods for providing traffic information. More particularly, various embodiments of the invention are operable to filter traffic information to limit user confusion.

2. Description of the Related Art

Navigation devices are commonly employed in automobiles to calculate travel routes and provide guidance using the Global Positioning System (GPS). Due to the desire to acquire the most accurate information for route planning and guidance, navigation devices have been configured to wirelessly receive traffic information from various sources. The received traffic information may be provided to drivers to allow appropriate route compensation around traffic delays.

Traffic information services commonly report all traffic events, such as car accidents, traffic jams, construction delays, and the like, within a broadcast area. Prior art navigation devices that communicate with traffic information services present all received traffic information to drivers—including information and events unrelated to drivers' current locations or routes. Consequently, drivers are often unnecessarily notified of an overabundance of traffic information.

SUMMARY OF THE INVENTION

Embodiments of the present invention solve the above-described problems and provide a distinct advance in the art of traffic information notification. More particularly, various embodiments of the invention are operable to filter traffic information to limit user confusion.

One embodiment of the present invention provides a device comprising a traffic component, a computing device coupled with the traffic component, and a display coupled with the computing device. The traffic component is operable to receive traffic data corresponding to a plurality of traffic events. The computing device is operable to acquire a current geographic location of the device and filter the received traffic data to form filtered traffic data. The display is operable to present an indication of the filtered data.

The computing device may filter the received traffic data by severity, location, route, road, direction, category, delay time, upcoming traffic events, combinations thereof, or the like, to ensure that relevant information is provided to users. Thus, rather than present all traffic information received by the traffic component, the device is operable to present filtered traffic information that is likely to be more relevant to users.

Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
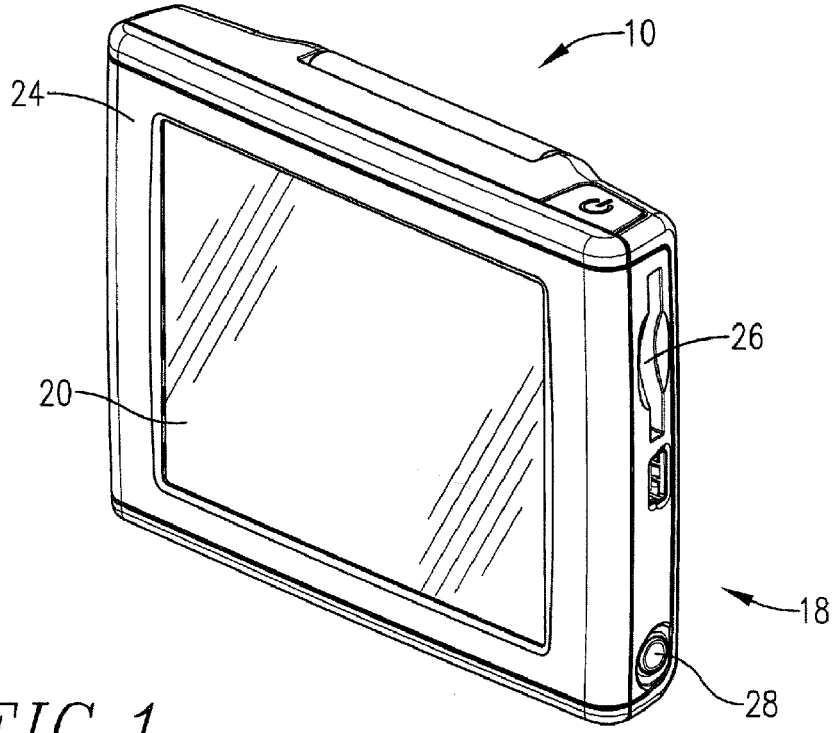
FIG. 1 is an isometric view of a navigation device configured in accordance with various embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

As is discussed in more detail below, embodiments of the present invention are generally operable to access traffic data, filter the accessed traffic data, and present the filtered traffic data. For example, the accessed traffic data may be filtered by severity, location, route, road, direction, category, delay time, combinations thereof, and the like, to ensure that relevant information is provided to users.

Figure 2:
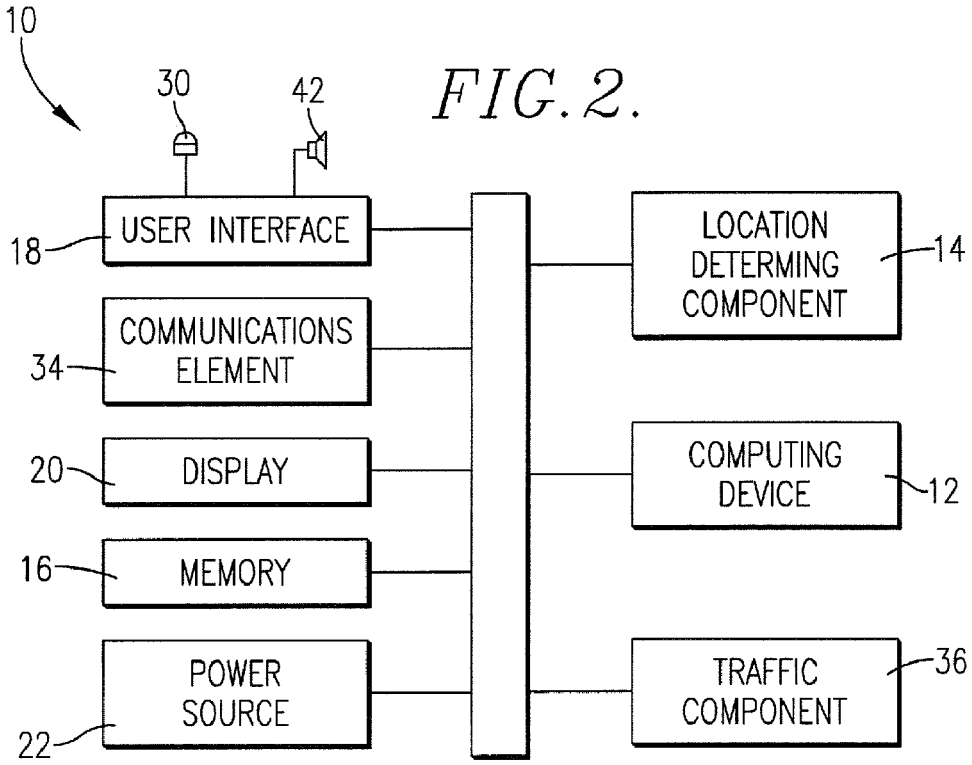
FIG. 2 is a block diagram of certain components of the navigation device of FIG. 1.

As shown in FIGS. 1 and 2, embodiments of the present invention may be implemented utilizing an electronic device 10. The device 10 may be any electronic device or system operable to receive, utilize, or otherwise determine geographic information, such as a current geographic location or traffic information associated with a location. Thus, the device 10 may include computers, televisions, radios, portable computing devices such as laptops or personal data assistants (PDAs), personal travel assistants, cellular telephones, portable entertainment devices, and the like. In some embodiments, the device 10 is a navigation device manufactured by GARMIN INTERNATIONAL, INC. of Olathe, Kans. However, the device 10 may be any device configured as described herein or otherwise operable to perform the functions described below.

The device 10 may include a computing device 12, a location determining component 14 coupled with the computing device 12 to facilitate determination of a current geographic location, a memory 16 coupled with the computing device 12 and operable to store information, a user interface 18 coupled with the computing device 12 and operable to communicate with a user, a display 20 and power source 22 each coupled with the computing device 12, and a housing 24 for housing the various components of the device 10.

The computing device 12 may comprise various computing elements, such as integrated circuits, microcontrollers, microprocessors, programmable logic devices, discrete logic components, application specific integrated circuits, and the like, alone or in combination, to perform the operations described herein. The computing device 12 may be coupled with the user interface 18, location determining component 14, memory 16, and display 20, through wired or wireless connections, such as a data bus, to enable information to be exchanged between the various elements.

Further, the computing device 12 may be operable to control the various functions of the device 10 according to a computer program, including one or more code segments, or other instructions associated with the memory 16 or with various processor logic and structure.

The computer program may comprise a plurality of code segments arranged as ordered listing of executable instructions for implementing logical functions in the computing device 12. The computer program can be embodied in any computer-readable medium, including the memory 16, for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any means that can contain, store, communicate, propagate or transport the program for use by or in connection with the instruction execution system, apparatus, or device. The computer-readable medium can be, for example, but not limited to, an electronic, magnetic, optical, electro-magnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, a compact disc (CD), a digital video disc (DVD), combinations thereof, and the like. The computer-readable medium could even be paper or another suitable medium upon which the program is printed, as the program can be electronically captured, via for instance, optical scanning of the paper or other medium, then compiled, interpreted, or otherwise processed in a suitable manner, if necessary, and then stored in the memory 16.

As described below in more detail, the computing device 12 may be operable to determine a current geographic location of the device 10 by receiving the geographic location from the location determining component 14 or from another device through the user interface 18. Alternatively, the computing device 12 may independently determine geographic locations based on information and/or data, such as received navigation signals, provided by the location determining component 14, stored within the memory 16, or acquired from other devices or elements.

The location determining component 14 may be a Global Positioning System (GPS) receiver, and is adapted to provide, in a substantially conventional manner, geographic location information for the device 10. The location determining component 14 may be, for example, a GPS receiver much like those disclosed in U.S. Pat. No. 6,434,485, which is incorporated herein by specific reference. However, the location determining component 14 may receive cellular or other positioning signals utilizing various methods to facilitate determination of geographic locations without being limited to GPS.

The GPS is a satellite-based radio navigation system that allows determination of navigation information, such as position, velocity, time, and direction, for an unlimited number of users. Formally known as NAVSTAR, the GPS incorporates a plurality of satellites that orbit the earth.

The location determining component 14 scans for GPS satellite signals and, upon receiving signals from at least three different satellite signals, the location determining component 14 utilizes the three satellite signals to determine its own position. Acquiring a fourth satellite signal will allow the location determining component 14 to calculate its three-dimensional position by the same calculations. As should be appreciated, the computing device 12 may be operable to perform one or more of these functions in place of the location determining component 14.

Although GPS enabled devices are often used to describe navigation devices, it will be appreciated that satellites need not be used to determine a geographic position of a receiving unit since any receiving device capable of receiving signals from multiple transmitting locations can perform basic triangulation calculations to determine the relative position of the receiving device with respect to the transmitting locations. For example, cellular towers or any customized transmitting radio frequency towers can be used instead of satellites. With such a configuration, any standard geometric triangulation algorithm can be used to determine the exact location of the receiving unit.

Figure 3:
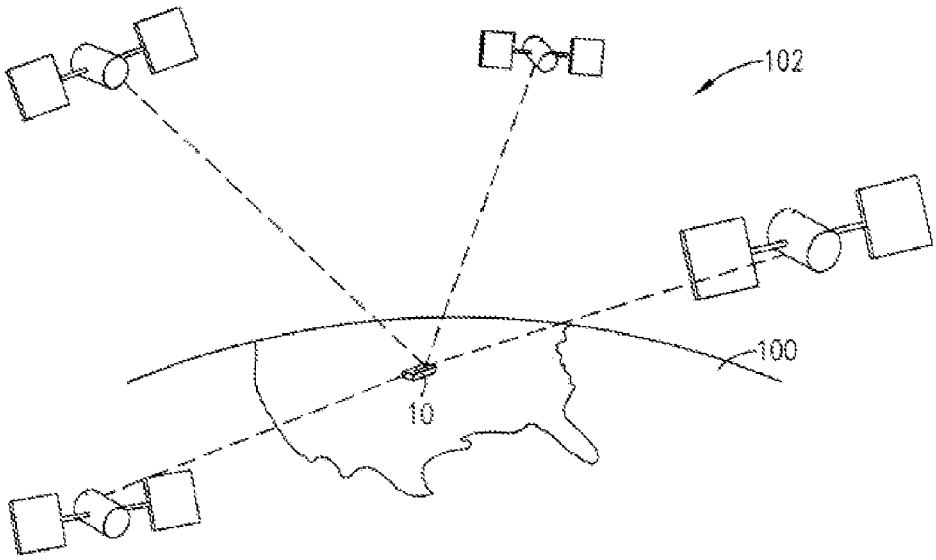
FIG. 3 is schematic diagram of a Global Positioning System (GPS) that may be utilized by various embodiments of the present invention.

FIG. 3 shows one representative view of a GPS denoted generally by reference numeral 102. A plurality of satellites are in orbit about the Earth 100. The orbit of each satellite is not necessarily synchronous with the orbits of other satellites and, in fact, is likely asynchronous. The navigation device 10, including the location determining component 14, is shown receiving spread spectrum GPS satellite signals from the various satellites.

The location determining component 14 may also include various processing and memory elements to determine the geographic location of the device 10 itself or it may provide information to the computing device 12 to enable the computing device 12 to specifically determine the geographic location of the device 10. Thus, the location determining component 14 need not itself calculate the current geographic location of the device 10 based upon received signals. The location determining component 14 also may include an antenna for receiving signals, such as a GPS patch antenna or helical antenna.

Further, the location determining component 14 may be integral with the computing device 12 and/or memory 16 such that the location determining component 14 may be operable to specifically perform the various functions described herein. Thus, the computing device 12 and location determining component 14 need not be separate or otherwise discrete elements.

In various embodiments the location determining component 14 does not directly determine the current geographic location of the device 10. For instance, the location determining component 14 may determine the current geographic location utilizing the user interface 18, such as by receiving location information from the user, through the communications network, from another electronic device, and the like.

The memory 16 is coupled with the computing device 12 and/or other device 10 elements and is operable to store various data utilized by the computing device 12 and/or other elements. The memory 16 may include removable and non-removable memory elements such as RAM, ROM, flash, magnetic, optical, USB memory devices, and/or other conventional memory elements.

Further, the memory 16 may comprise a portion of the user interface 18 to enable the user to provide information to the device 10 via the memory 16, such as by inserting a removable memory element into a slot 26 to provide information and instruction to the device 10. The memory 16 may also be integral with the computing device 12, such as in embodiments where the memory 16 comprises internal cache memory.

The memory 16 may store various data associated with operation of the device 10, such as a computer program, code segments, or other data for instructing the computing device 12 and other device 10 elements to perform the steps described below. Further, the memory 16 may store various cartographic data corresponding to geographic locations including map data, and map elements, such as thoroughfares, terrain, alert locations, points of interest, geographic entities, traffic information and events, and other navigation data to facilitate the various navigation functions provided by the device 10. Additionally, the memory 16 may store destination addresses and previously calculated or otherwise acquired routes to various destination addresses for later retrieval by the computing device 12.

Further, the various data stored within the memory 16 may be associated within a database to facilitate computing device 12 retrieval of information. For example, the database may be configured to enable the computing device 12 to retrieve geographic locations, road names, geographic entities, and traffic information based upon a current geographic location of the device 10, as is discussed at length below.

The user interface 18 enables users, third parties, or other devices to share information with the device 10. The user interface 18 is generally associated with the housing 24, such as by physical connection through wires, and the like, or wirelessly utilizing conventional wireless protocols. Thus, the user interface 18 need not be physically coupled with the housing 24.

The user interface 18 may comprise one or more functionable inputs 28 such as buttons, switches, scroll wheels, and the like, a touch screen associated with the display 20, voice recognition elements such as a microphone 30, pointing devices such as mice, touchpads, trackballs, styluses, a camera such as a digital or film still or video camera, combinations thereof, and the like. Further, the user interface 18 may comprise wired or wireless data transfer elements such as removable memory including the memory 16, data transceivers, and the like, to enable the user and other devices or parties to remotely interface with the device 10.

In some embodiments, the user interface 18 may include a communications element 34 to enable the device 10 to communicate with other computing devices, navigation devices, and any other network enabled devices through a communication network, such as the Internet, a local area network, a wide area network, an ad hoc or peer to peer network, or a direct connection such as a USB, Firewire, or Bluetooth connection, and the like. Similarly, the user interface 18 may be configured to allow direct communication between similarly configured navigation devices, such that the device 10 need not necessarily utilize the communications network to share geographic location or traffic information.

In various embodiments the communications element 34 may enable the device 10 to wirelessly communicate with communications networks utilizing wireless data transfer methods such as WiFi (802.11), Wi-Max, Bluetooth, ultra-wideband, infrared, cellular telephony, radio frequency, and the like. However, the communications element 34 may couple with the communications network utilizing wired connections, such as an Ethernet cable, and is not limited to wireless methods.

The user interface 18 may be operable to provide various information to the user utilizing the display 20 or other visual or audio elements such as a speaker 42. Thus, the user interface 18 enables the user and device 10 to exchange information relating to the device 10, including traffic information and events, geographic entities, configuration, security information, preferences, route information, points of interests, alerts and alert notification, navigation information, waypoints, traffic information, a destination address, and the like.

The display 20 is coupled with the computing device 12 and/or other device 10 elements and is operable to display various information corresponding to the device 10, such as traffic information and events, maps, locations, and navigation information as is described below. The display 20 may comprise conventional black and white, monochrome, or color display elements including CRT, TFT, and LCD devices. The display 20 may be of sufficient size to enable the user to easily view the display 20 to receive presented information while in transit.

Further, as described above, the display 20 may comprise a portion of the user interface 18, such as in embodiments where the display 20 is a touch-screen display to enable the user to interact with the display 20 by touching or pointing at display areas to provide information to the device 10.

In some embodiments, the display 20 is mounted separately from the traffic component, discussed below, and the computing device 12. Thus, the device 10 may provide an input or other connector for removable coupling with an external display, such that the device 10 does not necessarily include the display 20.

The power source 22 is associated with the housing 24 to provide electrical power to various device 10 elements. For example, the power source 22 may be directly or indirectly coupled with the user interface 18, location determining component 14, computing device 12, memory 16, and/or display 20. The power source 22 may comprise conventional power supply elements, such as batteries, battery packs, and the like. The power source 22 may also comprise power conduits, connectors, and receptacles operable to receive batteries, battery connectors, or power cables. For example, the power source 22 may include both a battery to enable portable operation and a power input for receiving power from an external source such as an automobile.

The housing 24 may be handheld or otherwise portable to facilitate transport of the device 10 between locations. In some embodiments, the housing 24 may be configured for mounting within or on an automobile in a generally conventional manner and may comprise generally conventional and durable materials, such as ABS, plastics, metals, and the like, to protect the enclosed and associated elements.

In some embodiments, the device 10 may lack the location determining component 14 and portable housing 24. Thus, in some embodiments the device 10 may comprise personal computers, desktop computers, servers, computing networks, personal digital assistants, laptops, cellular phones, portable entertainment and media devices, combinations thereof, and the like, configured to perform one or more of the steps discussed below. For instance, the device 10 may comprise a server operable to execute a computer program or code segment to perform one or more of the below steps or portions thereof.

In various embodiments, the device 10 additionally includes a traffic component 36 operable to receive traffic information from external sources. The traffic component 36 may be integral with the user interface 18, such as in embodiments where the traffic component 36 is integrated with the communications element 34. The traffic component 36 may include wired or wireless receiver components, such as those discussed above regarding the communications element 34, to receive traffic information from external sources such as other similarly configured navigation devices, computers and computing devices, computing and broadcast networks, and the like.

In various embodiments, the traffic component 36 may comprise radio-frequency (RF) receivers, optical receivers, infrared receivers, wireless fidelity (WiFi) devices, ultra wideband (UWB) devices, short-range wireless devices such as Bluetooth and Zigbee compatible devices, Global System for Mobile (GSM) communication devices, Code Division Multiple Access (CDMA) devices, Worldwide Interoperability for Microwave Access (Wi-Max) devices, other 802.11 compliant devices, satellite radio devices such as XM or SIRIUS receivers, combinations thereof, and the like.

In some embodiments, the traffic component 36 is operable to receive frequency modulated (FM) signals. Thus, the traffic component 36 may include a FM receiver containing or operable for coupling with an antenna to receive FM radio signals. However, in other embodiments, the traffic component 36 may be operable for coupling with a conventional FM receiver and antenna, such as by including an interface for coupling with a generally conventional automobile radio system, a satellite radio system, or an external radio receiver and antenna.

The traffic component 36 may be operable to receive and/or process traffic information, such as Traffic Message Channel (TMC) formatted information. Traffic information, such as road conditions, weather conditions, accident locations, areas of congestion, and the like, may be provided as TMC formatted information and broadcast over conventional FM frequencies, or through satellite radio, for reception by various devices.

In order to broadcast TMC formatted information and associated data without interfering with audio transmissions, TMC formatted information is typically digitally encoded for transmission utilizing Radio Data System (RDS) and/or Radio Broadcast Data System (RDBS) information. As utilized herein, "RDS signal" refers to both RDS and RDBS signals, as RDS and RDBS are often used interchangeably by those skilled in the art.

Thus, the traffic component 36 may be operable to receive or otherwise acquire a FM-RDS signal including TMC formatted information. The traffic component 36 may include an integral processor, such as a TEA5764 FM radio with RDS and RBDS demodulation and decoding, distributed by PHILIPS SEMICONDUCTORS, or be operable to provide data and information to the computing device 12 for RDS and TMC decoding.

The traffic component 36 and/or computing device 12 may be operable to demodulate and/or decode the received FM-RDS signal to extract or otherwise generate TMC formatted information. The TMC formatted information may include an event code and a location code. TMC formatted information may additionally or alternatively include event incident data, such as the cause and location of a traffic slowdown, and flow data corresponding to traffic flow at the identified location.

Additionally or alternatively, in some embodiments the traffic component 36 may receive TMC formatted information, including event codes and location codes, or any other traffic information, without decoding or receiving FM or FM-RDS signals as the traffic component 36 may be operable to receive traffic information and data using other methods.

In some embodiments the received traffic information need not correspond to TMC formatted information. As discussed above, the traffic component 36 is operable to receive data and information from various sources, including computing networks and satellite radio broadcasts. Thus, the traffic component 36 may be operable to receive XM Radio formatted traffic information, MSN Direct formatted traffic information, and/or any other type of traffic information and data, in addition to, or instead of, TMC formatted traffic information.

Figure 9:
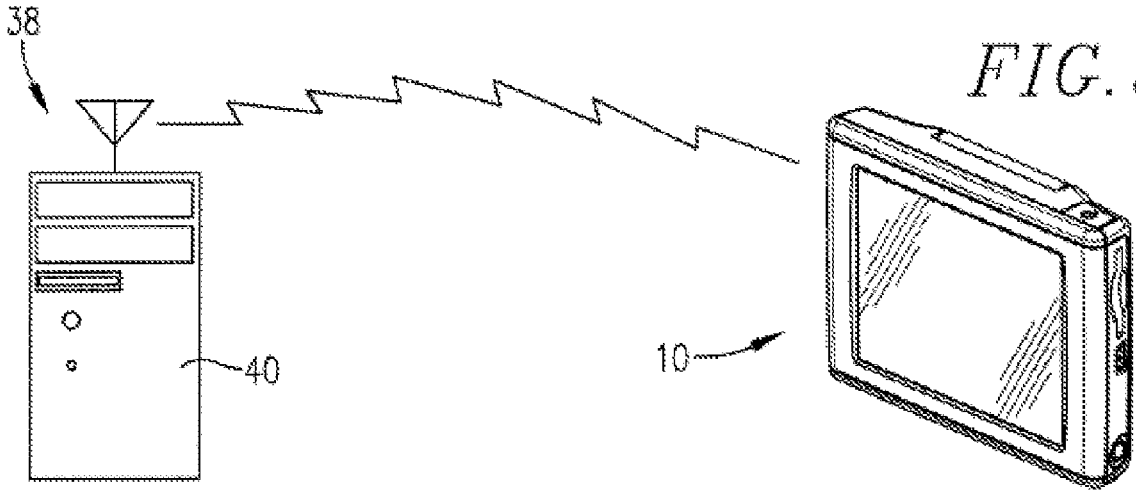
FIG. 9 a block diagram showing a system provided by various embodiments of the present invention.

In some embodiments, and as shown in FIG. 9, the present invention provides a system 38 comprising the device 10 and a computing element 40 operable to communicate with the device 10 using wired or wireless methods, such as by broadcasting radio frequency signals, transmitting information through the Internet or a LAN, broadcasting information to a wireless network, providing information to a communications network, and the like.

The computing element 40 may comprise computing devices such as personal computers, servers, computing networks, distributed computing devices, portable computing devices, combinations thereof, and the like. The computing element 40 may be operable to wirelessly communicate with the device 10, such as by broadcasting or transmitting TMC formatted traffic information for reception by the traffic component 36, as discussed above. In some embodiments, the computing element 40 may include or be coupled with a FM transmitter, a satellite radio transmitter, or other wireless transmitters, to facilitate communication with the device 10. However, the computing element 40 may provide traffic information to the device 10 utilizing any data transfer or communication method.

Figure 4:
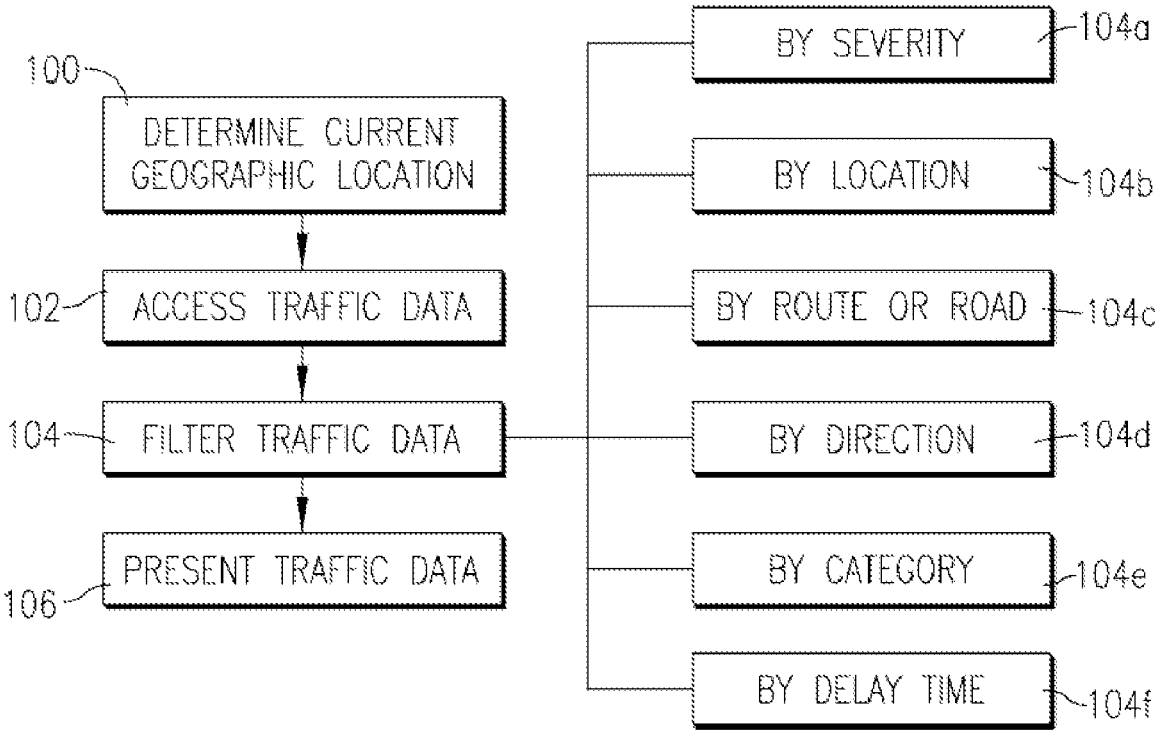
FIG. 4 is a flow chart showing some of the steps that may be performed by various embodiments of the present invention.

FIG. 4 generally illustrates various methods that may be performed by embodiments of the present invention. Steps 100-106 generally include: determining a current geographic location, referenced at step 100; accessing traffic data, referenced at step 102; filtering the accessed traffic data, referenced at step 104; and presenting the filtered data, referenced at step 106.

Steps 100-106 may be performed in any order and are not limited to the specific order described herein. Further, steps 100-106 may be performed simultaneously or concurrently such that the steps are not necessarily sequential. Further, steps 100-106 are not each necessarily performed by all embodiments of the present invention and are not necessarily performed in the order listed herein.

In step 100, the current geographic location is determined. In various embodiments, the determined current geographic location corresponds to the current geographic location of the device 10. However, in some embodiments the current geographic location may correspond to a user location independent of the location of the device 10.

The current geographic location of the device 10 may be determined as described above utilizing the location determining component 14. Thus, for instance, the current geographic location may be determined in step 100 by receiving GPS signals and computing the current geographic location from the received GPS signals.

However, as is also described above, the current geographic location may be determined utilizing other methods, such as by retrieving the current geographic location from the memory 16, the user interface 18, and/or from another device such as the computing element 40. For example, the current geographic location may be determined by allowing the user to select his or her location from a map or listing presented by the display 20.

Step 100 may be repeated continuously or at regular intervals to ensure that the device 10 is provided with an accurate current geographic location as the device 10 changes position.

In step 102, traffic data is accessed. The accessed traffic event data may correspond to any information that indicates traffic conditions. For example, the accessed traffic data may correspond to a plurality of traffic events and include information corresponding to the location and nature of each event. Each traffic event may indicate a traffic condition, such as a rate of traffic flow, a car accident, a traffic jam, a construction area, and the like. As discussed above, in some embodiments the accessed traffic data may include TMC formatted information including event codes, location codes, extent, direction, and duration to indicate incident and flow information.

In various embodiments, the traffic data is accessed by wirelessly receiving the data. For instance, as discussed above, the traffic data may be received by the traffic component 36 utilizing FM-RDS and/or satellite radio services. Similarly, the traffic data may be retrieved from computing devices such as the computing element 40, navigation devices, and/or computing networks, such as the Internet or a LAN, using wired or wireless connections.

Additionally or alternatively, the traffic data may be accessed by retrieving previously stored data from a memory, such as the memory 16. For instance, the memory 16 may store traffic data, provided from any source, and the computing device 12 may access the memory 16 to retrieve stored traffic data therefrom. Thus, in some embodiments, traffic data may be wirelessly received utilizing the traffic component 36, stored within the memory 16, and then later accessed by the computing device 12. In other embodiments, the traffic data may be manually or automatically entered into the memory 16 for storage using the user interface 18, such as in response to a reported traffic accident or delay, and then later accessed by the computing device 12 for processing as discussed below.

In step 104, the accessed traffic data is filtered. In particular, the accessed traffic data is filtered to organize, arrange, format, and/or limit the accessed traffic data to simplify the presentation of information to the user. For instance, in some embodiments the accessed traffic data may be filtered to remove traffic data and information to simplify presentation of information to the user. In other embodiments, the accessed traffic data may be formatted and organized to present information to the user in a meaningful fashion without removing or limiting the amount of traffic information presented to the user. Thus, the accessed traffic data may be filtered in any manner, including any combination of the methods discussed in steps 104*a* through 104*f* below.

In step 104*a*, the accessed traffic data is filtered by severity. In some embodiments, the traffic data accessed in step 102 may include information corresponding to the severity of each of the traffic events represented by the data. For example, received traffic information, such as TMC, XM, and MSN Direct traffic information, may indicate that a particular traffic event is of low, moderate, or high severity. In such embodiments, the accessed traffic data may be filtered to form filtered traffic data that includes representations of only the moderate and high severity traffic events. Such a configuration may be desirable as it prevents the user from being notified of low severity traffic events, which are unlikely to substantially alter the user's navigation and transportation plans.

As should be appreciated, in some embodiments the accessed traffic data may indicate severity in any manner and is not limited to the low-moderate-high indicators discussed above. For example, traffic data and/or the computing device 12 may indicate severity by employing a 0-10 scale, an estimated delay time, an A-F scale, or the like. Further, accessed traffic data may be filtered by severity in any manner, such as by allowing the user to determine, using the user interface 18, the severity threshold required for events to be included in the filtered traffic data.

In embodiments where the accessed traffic data does not include event severity information, the computing device 12 is operable to determine traffic event severity by processing the accessed data. For instance, the computing device 12 may determine a severity for each of the traffic events corresponding to the accessed data by identifying the flow for each event, such as the rate of traffic through each event, and/or an estimated time delay resulting from each event. The computing device 12 may identify events having low flow rates as moderate or high severity events while identifying events having high or regular flow rates as low severity events. Similarly, the computing device 12 may identify events having minimal time delays, such as under one or two minutes, as being of low severity. The computing device 12 may also use the locations of the traffic events to ascertain their severity, such that traffic events having locations in areas likely to impact the user's travel may be regarded as high severity while traffic events having locations unlikely to significantly impact the user's travel may be excluded from the filtered traffic data. The user may also function the user interface 18 to set severity preferences that may be used by the computing device 12 to identify event severity.

The computing device 12 may further be operable to determine a change in event severity. Specifically, the computing device 12 is operable to monitor the severity of a plurality of traffic events, through repetition of step 104*a*, and detect when the severity of an event changes. For example, the computing device 12 is operable to identify when the flow, duration, location, and the like, of an event changes and accordingly determine if the severity of the event has also changed. The computing device 12 may also determine if two traffic events correspond to the same traffic problem, such as where a car accident is reported by a traffic information service as being a car accident at a first location and a traffic slowdown at a second location. The filtered traffic data may include an indication of the events that have changed in severity such that the user is not repeatedly notified in step 106 of the same traffic events.

In step 104*b*, the accessed traffic data is filtered by location. In some embodiments, the traffic data accessed in step 102 may include a location for each of the traffic events. In such embodiments, the accessed traffic data may be filtered by only including traffic events having locations within a predetermined range from the current geographic location, determined in step 100, within the filtered traffic data. For instance, the computing device 12 may exclude traffic events having locations more than a predetermined range, such as 25 miles, from the current geographic location of the device 10. In some embodiments, the computing device 12 may dynamically modify the predetermined range based upon the speed of the device 10 or other factors to appropriately enlarge or shorten the range. Additionally, the user may set the predetermined range utilizing the user interface 18.

The computing device 12 may also filter the accessed traffic data by location according to the map zoom level presented on the display 20. As is known in the art, electronic and navigation devices are often operable to present a zoomable map, defining a dynamically adjustable area, to facilitate navigation. Based upon the area represented on the display 20, the computing device 12 is operable to identify traffic events having locations corresponding to the represented area and include only those events within the filtered traffic data.

In step 104*c*, the accessed traffic data is filtered according to route or road. As discussed above, the traffic data accessed in step 102 may include a location for each of the traffic events. In some embodiments, the accessed traffic data may also include the roads to which the traffic events correspond, such as the road, highway, street, intersection, and the like, where traffic accidents, traffic jams, road construction, and the like, exist. In embodiments where the traffic data includes locations of the traffic events but not corresponding roads, the computing device 12 is operable to identify the corresponding roads by comparing the geographic locations of the traffic events to information stored within the memory 16.

Specifically, the computing device 12, or in some embodiments the computing element 40, is operable to determine the road being currently traveled by the device 10. For instance, the computing device 12 may compare the current geographic location of the device 10, acquired in step 100, to information stored within the memory 16 to ascertain the currently traveled road. The user may also input the currently traveled road utilizing the user interface 18.

Traffic events not corresponding to the currently traveled road, such as traffic events having locations not on or in proximity to the currently traveled road, may be filtered and excluded from the filtered traffic data. Such a configuration reduces the amount of traffic information presented to the user by limiting the filtered data to traffic events that are likely to impact the user.

In some embodiments, the computing device 12 is operable to calculate a route from the current geographic location of the device 10 to a desired destination. The destination may be provided by the user through the user interface 18 or automatically selected by the computing device 12. The calculated route generally comprises a path from the current location to the destination through a plurality of roads. In embodiments where the computing device has calculated a route that is being traversed by the device 10, the filtered traffic data may be formed to include only traffic events having locations that correspond to the roads that form the calculated route.

Thus, where the user is following a route provided by the device 10, the filtered traffic data may only include traffic events corresponding to the route. Where the device 10 has not calculated a route, the filtered traffic data may only include traffic events corresponding to the currently traveled road. As should be appreciated, step 104*c* may be performed in combination with other steps, such as by limiting the filtered traffic data to events having locations within a predetermined range and corresponding to a currently traveled road or route.

In step 104*d*, the accessed traffic data is filtered based upon direction. As discussed above, the traffic data accessed in step 102 may include a location for each of the traffic events. In some embodiments, the accessed traffic data may include a direction for each of the events, such as northbound, southbound, eastbound, westbound, and the like, indicating the direction of traffic affected by the traffic events. In embodiments where the accessed traffic data does not include the directions of the traffic events, the computing device 12 is operable to ascertain the direction of the events by comparing the locations to information stored within the memory 16.

Additionally, the computing device 12, or in some embodiments the computing element 40, is operable to determine the direction of travel of the device 10. For instance, by comparing changes in the current geographic location of the device 12, as determined in step 100, the computing device 10 may ascertain the direction of travel of the device 10. Similarly, where a route has been calculated by the computing device 12, the direction of travel of the device 10 may be determined based on the direction suggested by the route.

Traffic events not having directions corresponding to the direction of the device 10 may be excluded from the filtered traffic data, as they are not likely to significantly impact the user's travel. As should be appreciated, step 104*d* may be performed in combination with other steps to further filter the accessed traffic data. For example, the accessed traffic data may be filtered such that the filtered traffic data includes only traffic events corresponding to the upcoming road or route traveled by the device 10 and the same direction of travel as the device 10.

In step 104*e*, the accessed traffic data is filtered by category. The traffic data accessed in step 102 may include category information, such as event type or duration. The accessed traffic data may be filtered to include only pre-defined traffic event categories. For example, the user may function the user interface 18 to indicate the category of traffic events that should be included within the filtered traffic data and the computing device 12 may filter the accessed traffic data accordingly. The computing device 12 may also automatically select the categories that should be included within the filtered traffic data.

The traffic event categories may also correspond to the order in which the events are expected to be encountered by the device 10. For instance, as discussed above, the computing device 12 is operable to determine the direction of travel of the device 10, the current geographic location of the device 10, and/or calculate a route from the current geographic location to a desired destination. Utilizing this information, the computing device 12 is operable to ascertain the order in which the traffic events represented by the accessed data are expected to be encountered. The computing device 12 may form the filtered traffic data to order the traffic events based the expected arrival of the device 10. Thus, the filtered data may include only the first traffic event expected to be encountered by the device 10 or an ordered listing of any number of the traffic events. As discussed below, such ordering and identification of traffic events facilitates user notification as the user may be easily informed of upcoming traffic events.

As should be appreciated, step 104*e* may be performed in combination with other steps to further filter the accessed traffic data. For example, the accessed traffic data may be filtered such that the filtered traffic data includes only upcoming traffic events within a predetermined range of the current geographic location of the device 10.

In step 104*f*, the accessed traffic data is filtered by delay time. The traffic data accessed in step 102 may include a delay time for each traffic event, such as an amount of time the traffic event is expected to delay the user. However, in other embodiments the computing device 12 is operable to calculate a delay time for each event utilizing traffic event information such as the severity, location, and duration of the events. In some embodiments, the computing device 12 may also use information concerning the device 10, such as its location, speed, direction, and route information to ascertain the anticipated delay time for each event.

The computing device 12, or in some embodiments the computing element 40, is operable to filter the accessed traffic data to calculate an estimated delay time such that the filtered traffic data includes the estimated delay time. The estimated delay time may correspond to the delay times of all the traffic events represented by the accessed data or only a portion of the represented traffic events. In various embodiments, the estimated delay time corresponds only to traffic events having locations on the same road, route, or direction of the device 10, as determined in step 104*c* and *d*. The filtered traffic data may represent the estimated delay time as a sum of the individual event delay times and/or by providing a representative indication, such as a long, medium, or short delay. The filtered traffic data may include all the information provided in the accessed traffic data in addition to the estimated delay time, such that the filtered traffic data does not necessarily include less information than the accessed traffic data.

In step 106, the filtered traffic data is presented. In various embodiments, the filtered traffic data is presented to the user to facilitate navigation. Thus, in some embodiments the filtered traffic data may be presented by providing an indication of the filtered traffic data on the display 20. For example, the computing device 12 may instruct the display 20 to present a text description of the filtered traffic data, by itself or in combination with other traffic events and traffic event groups. The text description may be presented in response to a functioning of the user interface 18 by the user or automatically when certain conditions are satisfied, such as the arrival of new traffic event data. The text description may include any information corresponding to the filtered traffic data, including its location and range, duration, extent, cause, category, flow, severity, time delay, combinations thereof, and the like.

Figure 5:
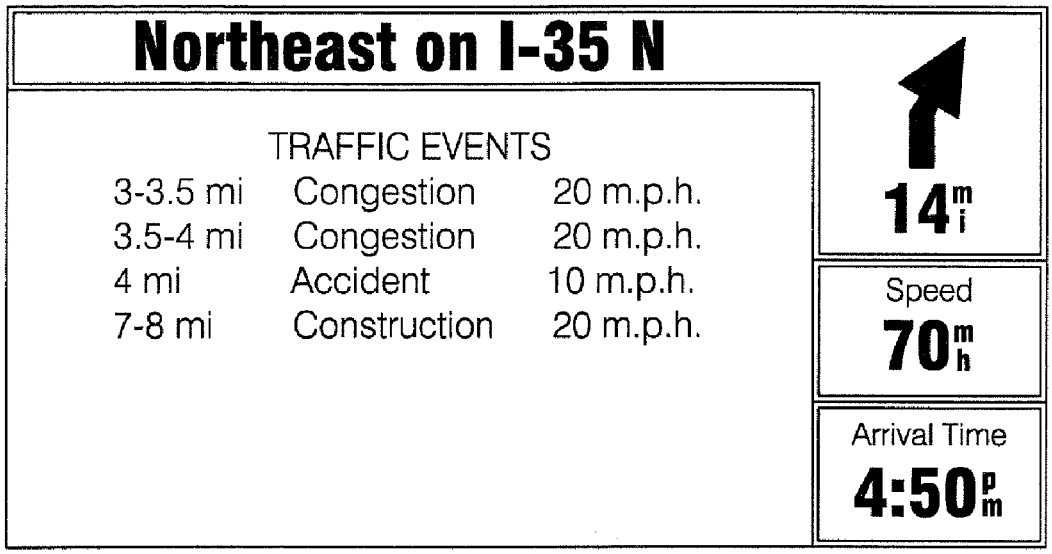
FIG. 5 is a first exemplary screen display provided by various embodiments of the present invention.

Similarly, the indication of the filtered traffic data may be graphically presented on the display 20, such as on a map to facilitate user-identification and navigation. In embodiments where the device 10 is operable to determine its current geographic location, the filtered traffic data may be displayed in relation to the current geographic location of the device 10 as shown in FIG. 5. Thus, for example, the display 20 may present a map indicating both the current location of the device 10 and the location(s) of the filtered traffic data and/or any other traffic events.

Figure 6:
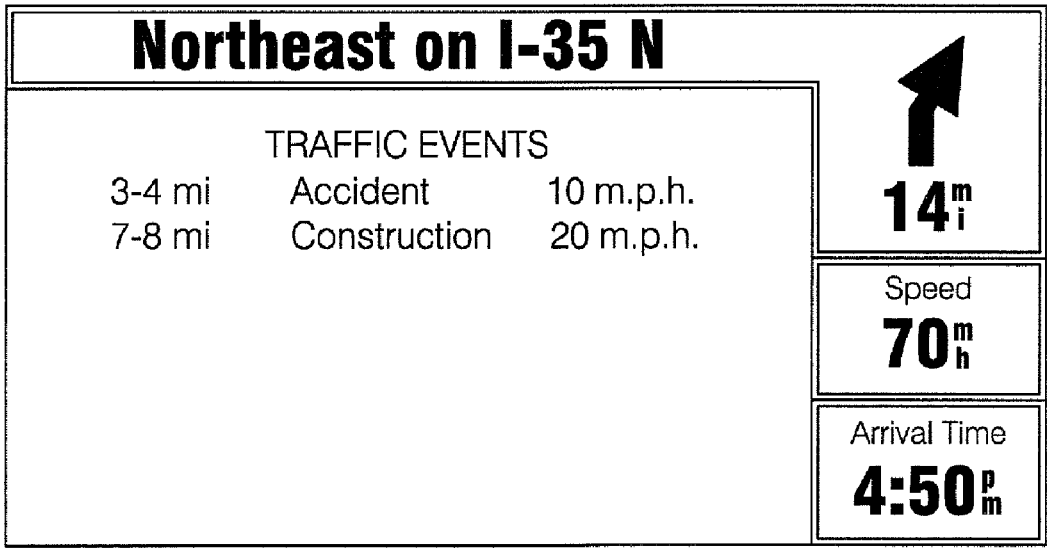
FIG. 6 is a second exemplary screen display provided by various embodiments of the present invention.
Figure 7:
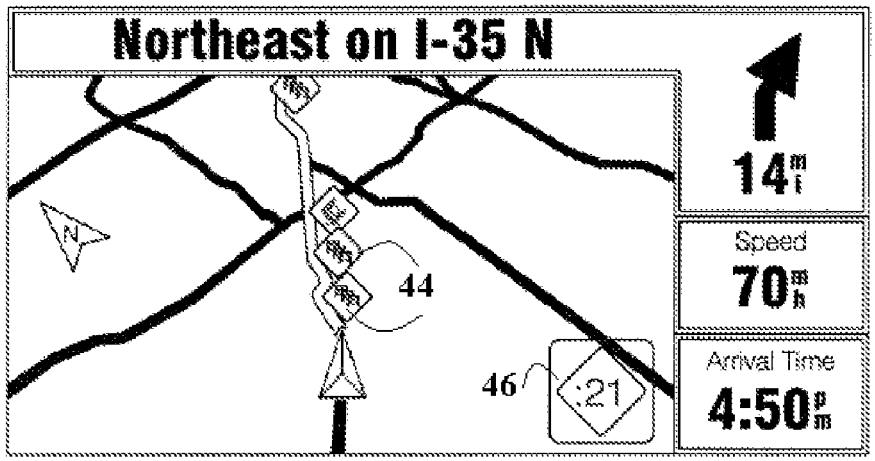
FIG. 7 is a third exemplary screen display provided by various embodiments of the present invention.

The representation of the traffic events may include presenting icons 44 corresponding to the locations of the traffic events on a map, as shown in FIGS. 5 through 7. In various embodiments, a magnified icon 46 is provided on the display 20 to facilitate identification of the next upcoming traffic event, as shown in FIG. 5. The magnified icon 46 may include a representation of only the next upcoming traffic event and/or a representation of a plurality of upcoming traffic events.

The magnified icon 46 may be presented continuously until the user exits the corresponding traffic event and then be updated to reflect the nature of the next upcoming traffic event. In some embodiments, the magnified icon 46 may be presented at regular intervals to limit obstruction of the display 20. Further, the magnified icon 46 may comprise a portion of the user interface 18, such as where the display 20 includes a touch-screen display, to allow the user to select the magnified icon 46 on the display 20 to access additional traffic information corresponding to the associated traffic event.

In some embodiments, at least one of the icons 44 may include a sign portion, which provides an indication of a traffic event, and a post extending therefrom to accurately indicate the location of the traffic event on the display 20. By utilizing the post having a precise end, the icons 44 are operable to more accurately represent the location of traffic events than presenting the sign portion by itself. The post may also extend from the sign portion towards a side of a displayed road to indicate the direction of the traffic event to which the sign portion corresponds. In some embodiments, the icons 44 may additionally or alternatively include other direction indicating elements, such as arrows, lines, or the like that indicate the direction of traffic events.

In embodiments where the delay time is included within the filtered traffic data, the magnified icon 46 may include an indication of the delay time, as shown in FIG. 7. As discussed above, the delay time may indicate the amount of time, for example in hours, minutes and/or seconds, which the user is expected to be delayed due to various traffic events. The delay time may be presented as an alternative or in addition to the category representations discussed above. The delay time may be displayed until there is no longer any delay, as calculated in step 104*f*, or until the delay reaches a minimum threshold or severity, as calculated in step 104*a*. Similarly, the delay time may be presented only if it exceeds the minimum threshold or severity.

As shown in FIGS. 5 and 6, the filtering of the accessed traffic data enables traffic information to be concisely presented to the user. For instance, as shown in FIG. 5, displaying icons 44 corresponding only to traffic events on the currently traveled road reduces map clutter to allow the user to clearly see the displayed road and surrounding areas. As shown in FIG. 6, even when traffic events are not filtered by current road, route, or direction, the use of the icons 44 and posts enables the user to identify the precise location of each traffic event.

Further, the indication of the filtered traffic data may be audibly presented by the user interface 18, such as by generating audible sound using the speaker 42. For instance, in response to the filtered traffic data, the device 10 may present audible sound such as "Accident ahead, 3 miles," "Road construction ahead, 5 minute delay," and the like. Thus, in contrast to providing an audible alert for all traffic information, embodiments of the present invention are operable to present audible alerts for the filtered traffic data to ensure relevant presentation of information to the user. The audible traffic data may be presented in combination with the displayed traffic data, such as by presenting an audible alert when a traffic event is detected and/or when a traffic delay increases or decreases by a certain threshold.

The audible traffic information may be presented continuously or at regular intervals. However, the audible traffic information may be presented only when the user has traveled through the traffic event that was described in the last audible alert or when the traffic event corresponding to the last audible alert is cleared or has been reduced in severity.

Figure 8:
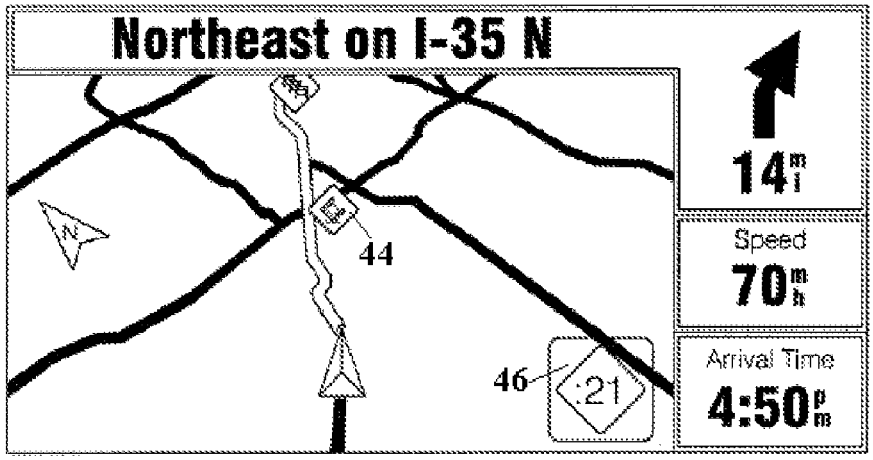
FIG. 8 is a fourth exemplary screen display provided by various embodiments of the present invention.

In some embodiments, such as where the computing element 40 forms the filtered traffic data, the filtered traffic data may be presented by transmitting the filtered traffic data to a remote navigation device, such as the device 10. Thus, the filtered traffic data is not necessarily displayed to the user. For example, as shown in FIG. 8, the computing element 40 may access traffic data (step 102), filter the data (step 104), and then transmit the formed traffic event group to the device 10. Upon reception of the filtered traffic data, the device 10 may store the group within the memory 16 or present it as discussed above.

Steps 100-106 may be repeated to provide current and accurate traffic information to the user. For example, traffic data may be accessed at regular intervals, or accessed continuously, in step 102 to ensure that the most accurate information is used for filtering. Each time new traffic data is received, or at any other interval, steps 104 and 106 may be performed to accurately identify and present filtered traffic data. The filtered traffic data may be continuously presented in step 106, or presented only at certain intervals or in response to functioning of the user interface 18.

In some embodiments, the computing device 12 may generate a history of the events represented by the filtered traffic data and presented in step 106. As steps 104 and 106 are repeatedly performed, the history may be utilized to prevent the user from being unnecessarily informed of known traffic events. For instance, if the user was audibly notified 30 seconds previously of a traffic event identified by the filtered traffic data, the history may be used to prevent the user from being notified again until the event has changed in severity and/or a predetermined duration has elapsed. The generated history may be reset when a new route is calculated, when a currently traveled route is canceled, when the user turns onto a new road, combinations thereof, and the like.

As should be appreciated, steps 100-106 discussed above may be employed in addition to conventional navigation device features, such as route calculation, and the like, to enable the device 10 to perform generally conventional navigation functions in addition to the functions performed by steps 100-106. Further, the device 10 may utilize the combination of navigation functions and traffic functions to calculate a route to a destination that avoids various traffic events.

Although the invention has been described with reference to the embodiments illustrated in the attached drawing figures, it is noted that equivalents may be employed and substitutions made herein without departing from the scope of the invention as recited in the claims.

Having thus described the various embodiments of the invention, what is claimed as new and desired to be protected by Letters Patent incudes the following:

1. A device, comprising:

a traffic component operable to receive traffic data corresponding to a plurality of traffic events;

a computing device coupled with the traffic component, the computing device operable to acquire a current geographic location of the device and calculate an estimated delay time utilizing the received traffic data; and a display coupled with the computing device, the display operable to be controlled by the computing device to present a map of an area in proximity to the current geographic location of the device and overlay on the map an indication of the estimated delay time.

2. The device of claim 1, wherein the computing device is further operable to determine a severity for each of the traffic events and exclude low severity events from the calculation of the estimated delay time.

3. The device of claim 1, wherein the computing device is further operable to acquire a current geographic location of the device, identify a road currently traveled by the device utilizing the acquired current geographic location, and exclude traffic events not corresponding to the currently traveled road from the estimated delay time calculation.

4. The device of claim 1, wherein the computing device is further operable to acquire a current geographic location of the device, calculate a route from the current geographic location to a destination, and exclude traffic events not corresponding to the route from the estimated delay time calculation.

5. The device of claim 1, further including a speaker coupled with the computing device, the speaker operable to audibly indicate the estimated delay time.

6. A device, comprising:

a location determining component operable to determine a current geographic location of the device;

a communications element operable to wirelessly receive traffic data corresponding to a plurality of traffic events;

a memory including a map information database;

a computing device coupled with the location determining component, the communications element, and the memory, the computing device operable to identify traffic events corresponding to the current geographic location of the device and calculate an estimated delay time based on the identified traffic events; and a display coupled with the computing device, the display operable to be controlled by the computing device to present:

a map of an area in proximity to the current geographic location of the device, one or more traffic icons placed on the map corresponding to the location of one or more of the identified traffic events, and an overlay on the map including an indication of the estimated delay time.

7. The device of claim 6, further including a portable and handheld housing for housing the location determining component, the communications element, the memory, the computing device, and the display.

8. The device of claim 6, wherein the communication element is selected from the group consisting of a cellular telecommunications transceiver, a FM-RDS radio traffic receiver, and a Wi-Fi communications transceiver.

9. The device of claim 6, wherein the received traffic data includes Traffic Message Channel (TMC) formatted information.

10. The device of claim 6, wherein the computing device is further operable to determine a severity for each of the traffic events and exclude low severity events from the calculation of the estimated delay time.

11. The device of claim 6, wherein the display presents the overlay on the map only when the estimated delay time exceeds a minimum threshold.

12. The device of claim 6, wherein the overlay comprises a magnified icon having a size larger than any one of the traffic icons.

13. The device of claim 6, wherein the computing device is operable to calculate a route from the current geographic location to a destination and the identified traffic events correspond to traffic events associated with the calculated route.

14. The device of claim 6, wherein the computing device is operable to identify a road currently traveled by the device based on the current geographic location of the device and the identified traffic events correspond to traffic events associated with the identified road.

* * * * *